United States Patent [19]

Hotchkiss et al.

[11] Patent Number: 4,930,635

[45] Date of Patent: Jun. 5, 1990

[54] JEWELRY DISPLAY BOOK

[75] Inventors: Calvin J. Hotchkiss; Nancy E. Hotchkiss, both of Anchorage, Ak.

[73] Assignee: Pac-Rim Trading Company, Inc., Anchorage, Ak.

[21] Appl. No.: 192,331

[22] Filed: May 10, 1988

[51] Int. Cl.[5] ..... B65D 73/00

[52] U.S. Cl. ..... 206/495; 206/45.11; 206/45.14; 206/6.1; 150/131; 150/154

[58] Field of Search ..... 206/44.11, 473, 495, 206/566, 45.14; 150/52 C, 131, 138, 139, 140, 154

[56] References Cited

U.S. PATENT DOCUMENTS

| | | | |
|---|---|---|---|
| D. 270,786 | 10/1983 | Handy et al. | D3/75 |
| D. 276,004 | 10/1984 | Mink | D3/75 |
| D. 286,552 | 8/1975 | Wagner et al. | D87/1 |
| D. 288,264 | 2/1987 | Courtwright et al. | D3/75 |
| D. 291,745 | 9/1987 | Hansen | D3/30.1 |
| 1,542,124 | 6/1925 | Halvorsen et al. | 150/138 |
| 1,679,101 | 7/1928 | Sternthal . | |
| 2,452,096 | 10/1948 | Bertalotto | 150/139 |
| 3,444,914 | 5/1969 | French et al. | 150/139 |
| 3,525,376 | 8/1970 | Muhlhauser | 150/52 |
| 3,900,060 | 8/1975 | Shammas | 150/52 R |
| 4,337,812 | 7/1982 | Trinkner | 150/52 R |
| 4,388,959 | 6/1983 | Handy et al. | 150/52 R |
| 4,401,219 | 8/1983 | Mink | 206/566 |
| 4,691,469 | 9/1987 | Alsobrook et al. | 150/52 R |
| 4,720,012 | 1/1988 | Dufour | 206/495 |
| 4,735,246 | 4/1988 | Niehaus | 150/52 R |
| 4,760,920 | 8/1988 | Thomsen | 206/495 |

*Primary Examiner*—David T. Fidei

*Attorney, Agent, or Firm*—Kenyon & Kenyon

[57] ABSTRACT

The disclosure is directed to a soft, book-like container for storing and displaying items of jewelry. The container generally comprises a pliable, foldable cover element made from a first, durable material and a page-like section made from a second, fabric material. The page-like section is affixed along one side edge to the cover element and is arranged relative to the cover element to permit folding of the cover element about the page-like fabric section to contain the page-like fabric section, Moreover, the page-like fabric section comprises a fabric loop having exterior jewelry display surfaces and inner mounting cap surfaces.

9 Claims, 4 Drawing Sheets

Fig. 1
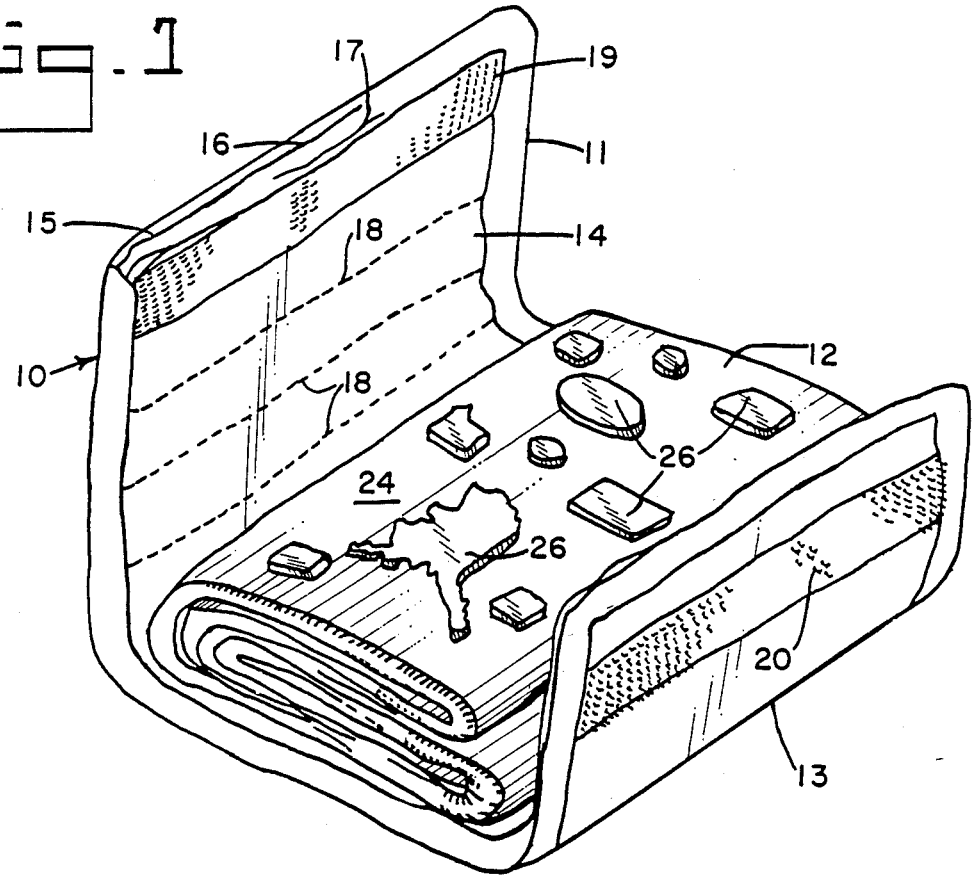
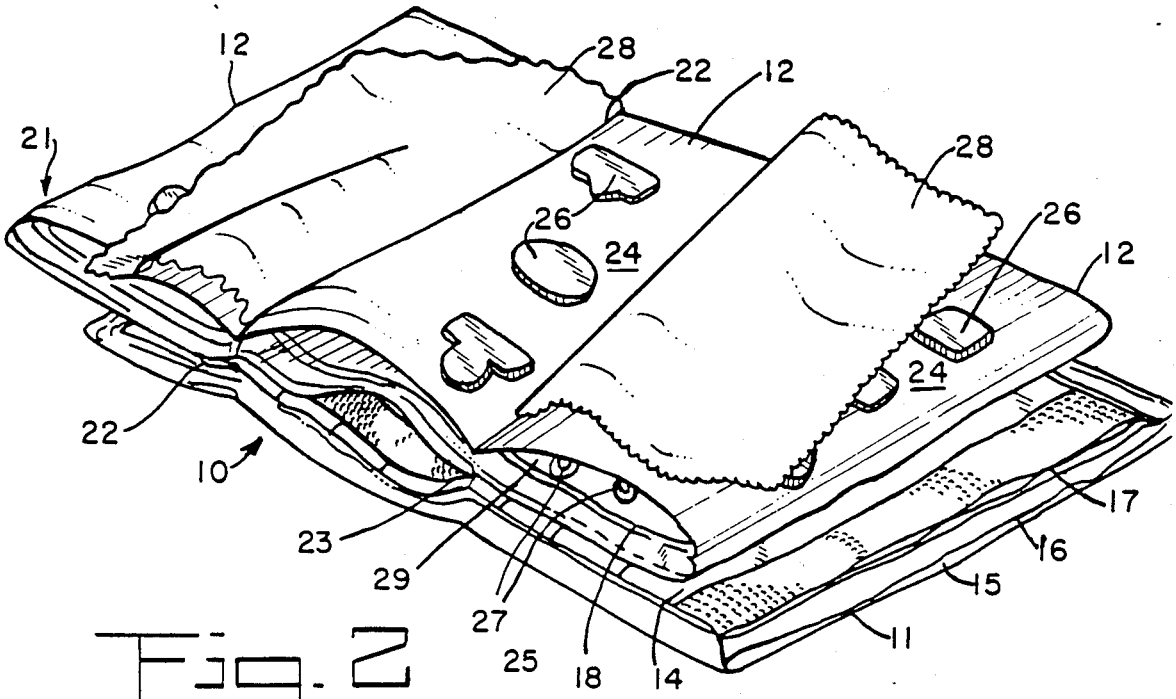
Fig. 2

JEWELRY DISPLAY BOOK

FIELD OF THE INVENTION

The present invention is directed to a soft container for the storage and display of individual jewelry pieces.

BACKGROUND AND SUMMARY OF THE INVENTION

Individual jewelry pieces are often stored in a single container such that it is convenient to safely transport the jewelry pieces and then open the container for display of the jewelry pieces contained therein. Typically, the container comprises a rigid, rectangular solid box including support structures within the box to securely mount and support several individual pieces of jewelry. The prior art has also proposed the use of soft envelope, pouch and wallet type containers which are made from pliable fabric materials to facilitate the carrying of the contained jewelry. Several of the prior soft jewelry containers generally comprise fabric sections which are connected to one another along fold lines such that the fabric sections may be folded over one another to form a closed container for the transport of the jewelry pieces and unfolded to be co-planar relative to one another and, thereby, provide a display surface for the jewelry previously enclosed by the folded over fabric sections.

It is a primary objective of the present invention to provide a soft, book-like jewelry container that can be utilized to both transport and display several individual jewelry pieces and, in particular, pin-type souvenirs. The jewelry container of the present invention comprises a rectangular, soft cover-forming element made from a pliable material and page-like, fabric sections arranged within the cover formed by the cover-forming element. The cover-forming element is foldable about predetermined fold lines to completely enclose the page-like fabric sections for safe and convenient transport of the jewelry pieces. The cover-forming element further includes a fastening means, such as a Velcro fastener, to retain the cover in its folded configuration.

Moreover, in accordance with a feature of the invention, the cover-forming element comprises a two ply arrangement with the interior sheet of pliable material being stitched to the exterior, protective sheet in a ribbed pattern to provide a cushioned cover about the page-like, fabric sections, for protection of the stored jewelry pieces during transport.

Each of the page-like, fabric sections is formed by a double layered fabric loop, as, for example, a corduroy fabric loop, such that individual jewelry pieces, as for example, souvenir pins, may be mounted to the exterior surfaces of each fabric layer of the loop with the pin of each souvenir pin piercing the respective layer and the fastening cap for the pin being affixed to the pin between the two layers of the loop of the respective page-like, fabric section. The page-like fabric sections are each fastened along one side edge to the cover-forming element so that they may be turned, similar to a page in a book, when the cover-forming element is unfolded, for convenient display of the mounted jewelry pieces. Additional felt page sections may also be fastened to either the cover-forming element or the double corduroy fabric sections to provide a protective fabric layer between jewelry pieces mounted on opposed corduroy page-like fabric sections.

The present invention, therefore, provides a convenient, practical and attractive article for the safe storage, transportation and display of individual jewelry pieces. A soft, cushioned protective cover surrounds the stored articles which are each securely fastened to soft, fabric page-like sections suitably fixed to the protective cover for convenient display upon unfolding of the cover. The book-like jewelry container of the present invention also provides an ideal article for the storage of a pin collection such as a collection of souvenir pins for member teams of a professional sports league.

For a better understanding of the above and other features and advantages of the present invention, reference should be made to the following detailed description and to the accompanying drawings.

BRIEF DESCRIPTION OF THE DRAWINGS

FIG. 1 is a perspective view of a book-like jewelry container in accordance with the present invention.

FIG. 3 is a bottom view of the book-like jewelry container of FIG. 1, in the unfolded configuration.

Figure 4:
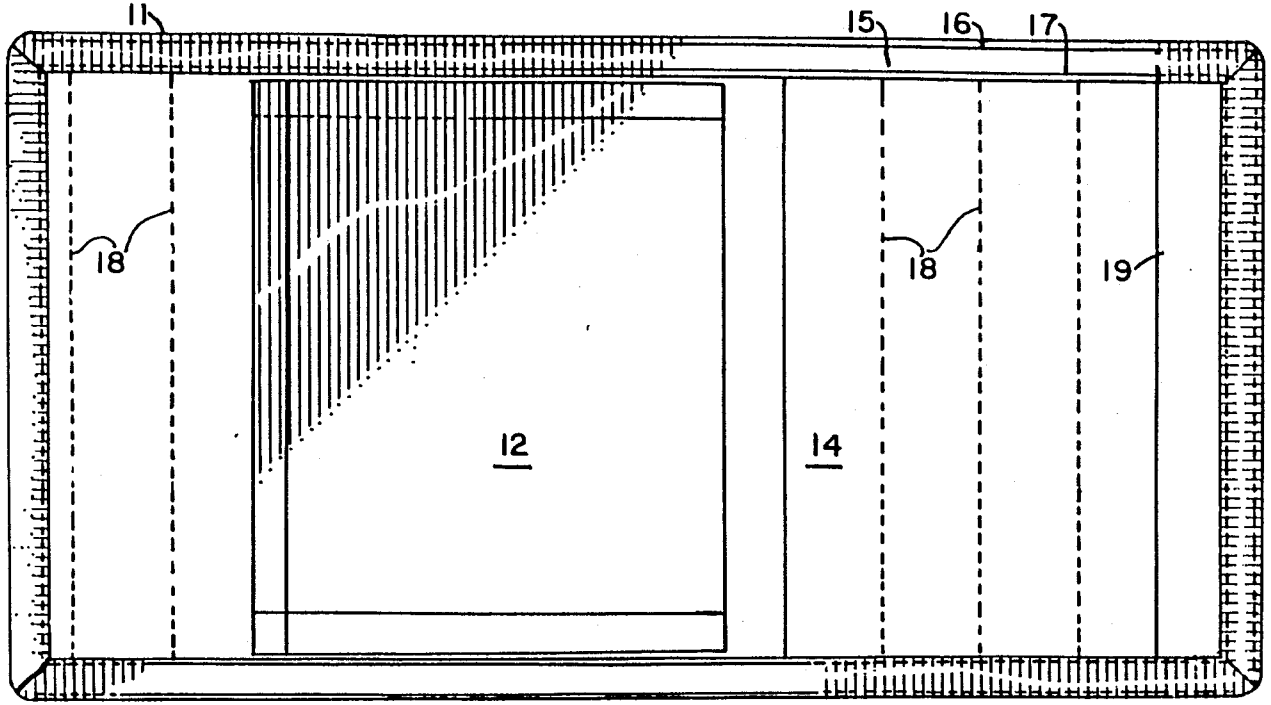
FIG. 4 is a top plan view of the book-like jewelry container of FIG. 3.

FIGS. *7a, b, c, d* illustrate the book-like jewelry container of FIG. 4 with various configurations for the page-like fabric sheets according to the invention.

DETAILED DESCRIPTION

Referring now to the drawings, and initially to FIG. 1, there is illustrated a book-like container generally indicated by the reference numeral 10. The jewelry container 10 comprises a protective cover element 11 which is arranged to fold about a plurality of page-like fabric sections 12. The protective cover element 11 is a two ply, pliable section including an outer protective layer 13 made from a rugged, weather proof material, such as nylon and an inner, soft surface texture layer 14 made from, for example, nylon tafetta. The two layers 13, 14 of the protective cover element 11 are held together by a fabric strip 15 which extends about and is folded over the confronting outer edges of the layers 13, 14 and is double stitched to secure the two layers 13, 14 together, as indicated by the reference numerals 16, 17. Moreover, a plurality of parallel stitch lines 18 are formed in the inner layer 14 to provide a ribbed, cushioned surface on the interior of the protective cover element 11. Accordingly, the rugged exterior surface and ribbed, cushioned interior surface of the cover element 11 assure maximum protection for articles of jewelry stored within the book-like container 10 according to the invention.

Figure 6:
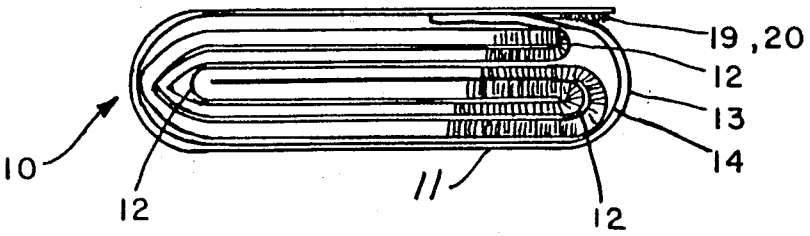
FIG. 6 is an end view of the book-like jewelry container of FIG. 4, in the folded configuration.
Figure 7A:
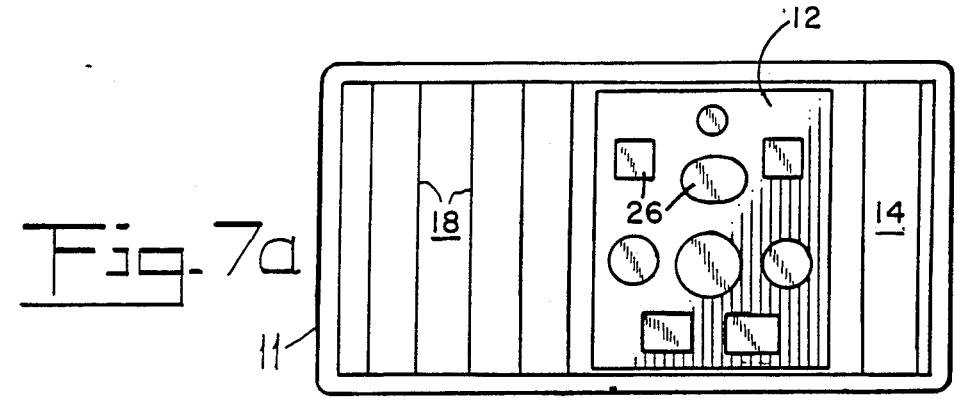
Figure 7B:
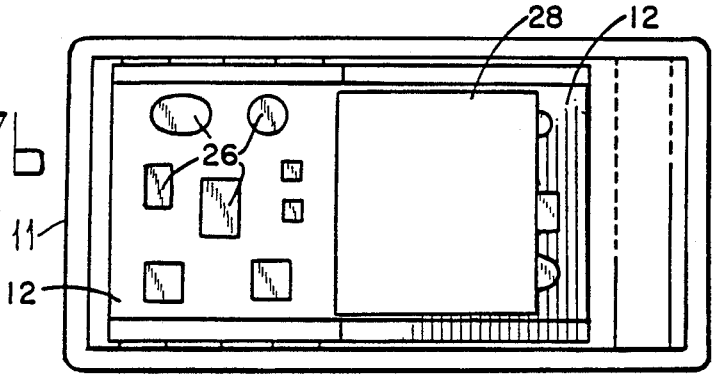
Figure 7C:
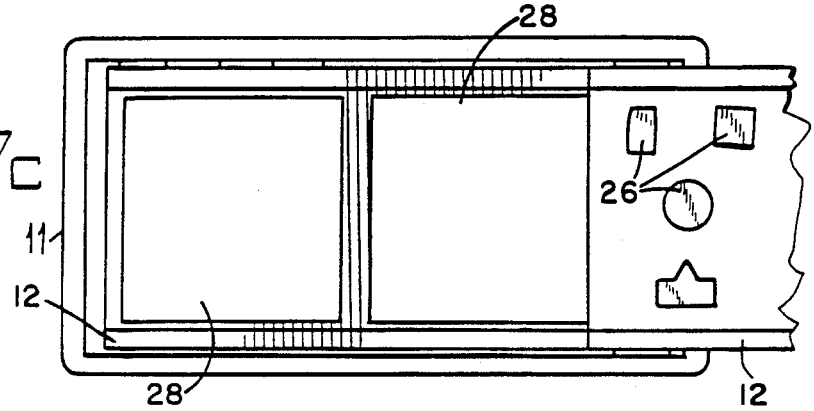
Figure 7D:
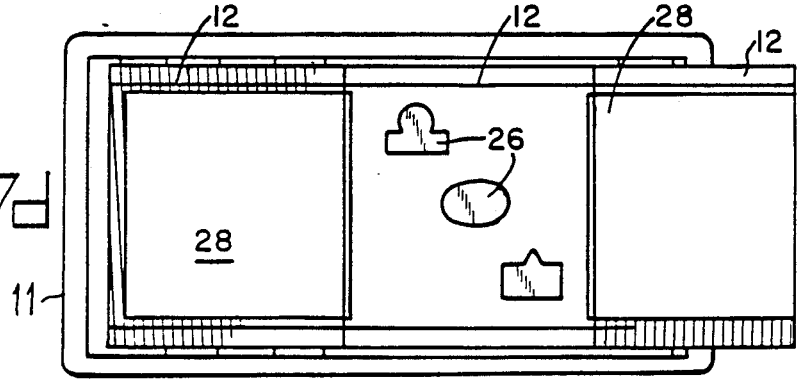

As most clearly illustrated in FIG. 6, the cover element 11 is foldable about the page-like fabric sections 12 to form an outer protective cover for safe and convenient carrying of the container 10 . Moreover, strips 19, 20 of, for example, Velcro fastener material (see FIG. 1) are affixed along an outer side edge of each of the inner soft layer 14 and outer protective layer 13, respectively, of the cover element 11 to selectively secure the cover element 11 in the folded shape illustrated in FIG. 6.

Figure 2:
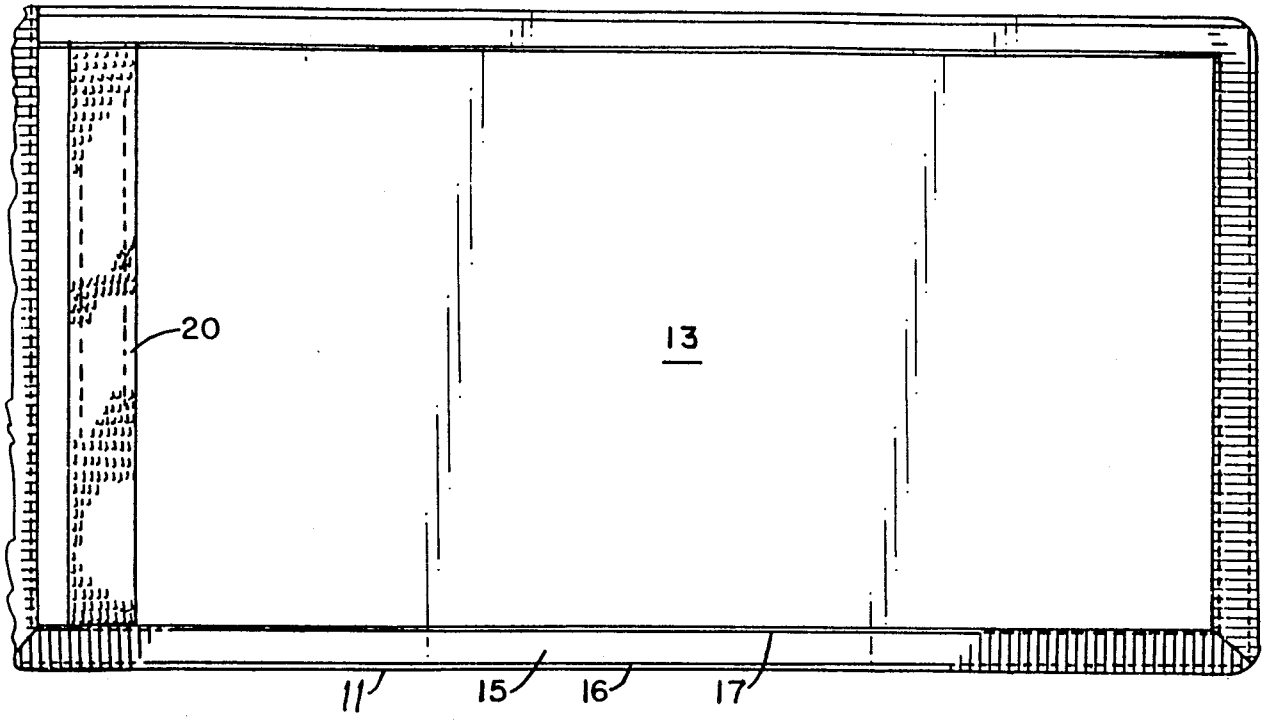
FIG. 2, is an additional perspective view of the book-like jewelry container of FIG. 1.
Figure 5:
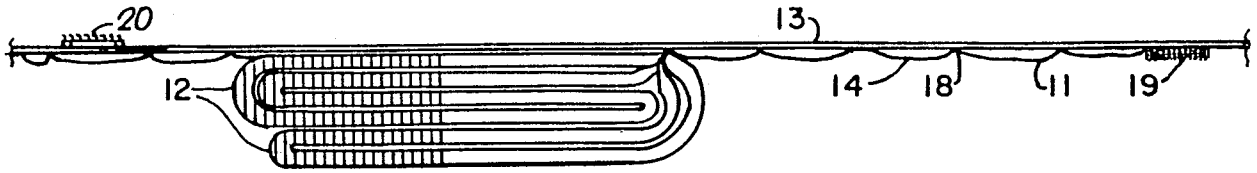
FIG. 5 is an end view of the book-like jewelry container illustrated in FIG. 4, in the unfolded configuration.

Referring now to FIG. 2, the page-like sections 12 each comprise a corduroy material and are most conveniently formed by providing a fabric tube 21 which is stitched to the cover element 11 along stitch lines 22, 23 to provide three individual page-like sections 12. In this manner, each of the page-like sections 12 comprises a fabric loop including outer jewelry display surfaces 24 and inner mounting cap surfaces 25. Accordingly, individual, pin-type articles 26 of jewelry can be securely mounted to the page-like fabric sections 12 with the ornamental part of each article 26 flush against the display surface 24, the pin (not shown) extending through the fabric of the section 12 and the corresponding mounting cap 27 affixed to the pin at the inner mounting cap surface 25 to secure the article 26 to the section 12.

As an additional feature of the invention, felt page sections 28 can be stitched to the page-like sections 12 along the stitch lines 22, 23 to provide a protective layer between the articles 26, as clearly illustrated in FIG. 2. A felt lining 29 may also be stitched to the mounting cap surfaces 25 of the page-like sections 12.

Referring now to FIGS. *7a, b, c, d,* there is illustrated various configurations for folding and unfolding the page-like sections 12 for display of the jewelry items. More specifically, FIG. *7a* is similar to FIG. 4 and illustrates the cover element 11 in the unfolded configuration, with the page-like sections 12 folded to display the top side display surface 24 of the left most page-like section 12. FIG. *7b* illustrates the left most page-like section 12 folded onto the left side of unfolded cover element 11 to display the bottom side display surface 24 of the left most page-like section 12. FIG. *7c* shows the right most page-like section 12 unfolded out of the cover element 11. The felt pages 28 may be turned right or left to expose the various display surfaces 24 of the unfolded page-like section 12, as shown, for example, on FIGS. *7c* and *7d*.

What is claimed is:

1. A soft container for storing and displaying items of jewelry, which comprises:

a pliable, foldable cover element made from a first, durable material; and a page-like section made from a second pliable material affixed along one side edge to said cover element and being arranged relative to the cover element to permit the folding of the cover element from the page-like section to contain the page-like section;

the page-like section being further arranged relative to the cover element to be rotatable about the one side edge;

the page-like section comprising a loop of the second pliable material having exterior jewelry display surfaces and inner mounting cap surfaces; and a protective layer affixed to the cover element and arranged to cover at least one exterior jewelry display surface when the cover element is folded about the page-like section.

2. The soft container of claim 1 wherein the protective layer comprises a felt section.

3. A soft container for storing and displaying items of jewelry, which comprises:

a pliable, foldable cover element made from a first, durable material;

a page-like section made from a second pliable material affixed along one side edge to said cover element and being arranged relative to the cover element to permit the folding of the cover element about the page-like section to contain the page-like section;

the page-like section being further arranged relative to the cover element to be rotatable about the one side edge;

the page-like section comprising a loop of the second pliable material having exterior jewelry display surfaces and inner mounting cap surfaces; and a protective layer affixed to the page-like section and arranged to cover at least one exterior jewelry display surface when the cover element is folded about the page-like section.

4. The soft container of claim 3 wherein the protective layer comprises a felt section.

5. The soft container of claim 3 wherein the cover element comprises a two ply element including an exterior ply made from a durable material and an interior ply made from a material having a soft surface texture.

6. The soft container of claim 5 wherein a plurality of parallel stitch lines are formed in the interior ply to provide a ribbed, cushion surface.

7. The soft container of claim 3 and further a closure element affixed to the cover element to secure the cover element when it is folded about the page-like section.

8. The soft container of claim 3 wherein the first, durable material comprises nylon and the second, pliable material comprises a corduroy fabric.

9. The soft container of claim 5 wherein the exterior ply comprises nylon and the interior ply comprises nylon taffeta.

* * * * *